US006360546B1

(12) United States Patent
Wang et al.

(10) Patent No.: US 6,360,546 B1
(45) **Date of Patent: *Mar. 26, 2002**

(54) FLUID STORAGE AND DISPENSING SYSTEM FEATURING EXTERNALLY ADJUSTABLE REGULATOR ASSEMBLY FOR HIGH FLOW DISPENSING

(75) Inventors: Luping Wang, Brookfield; Glenn M. Tom, New Milford, both of CT (US); James A Dietz, Hoboken, NJ (US); Steven M. Lurcott, Sherman, CT (US); Steven J. Hultquist, Chapel Hill, NC (US)

(73) Assignee: Advanced Technology Materials, Inc., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/635,961

(22) Filed: Aug. 10, 2000

(51) Int. Cl.[7] ..... F17C 7/04; F17C 13/02; B67D 5/00

(52) U.S. Cl. ..... 62/48.1; 62/49.1; 222/3

(58) Field of Search ..... 62/46.1, 48.1, 62/45.1, 49.1, 51.1; 222/3

(56) References Cited

U.S. PATENT DOCUMENTS

| | | | | |
|---|---|---|---|---|
| 1,659,263 | A | 2/1928 | Harris | |
| 1,679,826 | A | 8/1928 | Jenkins | |
| 2,047,339 | A | 7/1936 | Thomas | |
| 2,354,283 | A | 7/1944 | St. Clair | |
| 2,502,588 | A | 4/1950 | Preston et al. | 62/48.1 |
| 2,553,486 | A | 5/1951 | Thomas | 62/48.1 |
| 2,615,287 | A | 10/1952 | Senesky | |
| 2,707,484 | A | 5/1955 | Rush | 62/48.1 |
| 2,793,504 | A | 5/1957 | Webster | |
| 3,388,962 | A | 6/1968 | Baumann et al. | |
| 3,590,860 | A | 7/1971 | Stenner | |

(List continued on next page.)

OTHER PUBLICATIONS

ANSI/CGA V–1–1994 American National/Compressed Gas Association, Standard for Compressed Gas Cylinder Valve Outlet and Inlet Connections, COmpressed Gas Assoc., Inc.

Integrated Flow Systems Inc., SR4 and SR3 Series Regulators with Operation and Features, 1700 Granite Creek Road, Santa Cruz, CA 95065.

*Primary Examiner*—William C. Doerrler
(74) *Attorney, Agent, or Firm*—Robert A. McLauchlan

(57) ABSTRACT

A fluid storage and dispensing system including a fluid storage and dispensing vessel enclosing an interior volume for holding a fluid. The vessel includes a fluid discharge port for discharging fluid from the vessel. A pressure regulating element in the interior volume of the fluid storage and dispensing vessel is arranged to flow fluid therethrough to the fluid discharge port at a set pressure for dispensing thereof. A controller external of the fluid storage and dispensing vessel is arranged to transmit a control input into the vessel to cause the pressure regulating element to change the set pressure of the fluid flowed from the pressure regulating element to the fluid discharge port. By such arrangement, the respective storage and dispensing operations can have differing regulator set point pressures, as for example a sub-atmospheric pressure set point for storage and a super atmospheric pressure set point for dispensing.

36 Claims, 5 Drawing Sheets

U.S. PATENT DOCUMENTS 3,699,998 A 10/1972 Baranowski Jr.
3,791,412 A 2/1974 Mays
3,972,346 A 8/1976 Wormser
3,994,674 A 11/1976 Baumann et al.
4,173,986 A 11/1979 Martin
4,211,086 A * 7/1980 Leonard et al. ..... 62/48.1
4,485,739 A 12/1984 Emmett ..... 102/200
4,624,443 A 11/1986 Eidsmore ..... 251/65
4,694,860 A 9/1987 Eidsmore ..... 137/614.21
4,744,221 A 5/1988 Knollmueller ..... 62/48
4,793,379 A 12/1988 Eidsmore
4,836,242 A 6/1989 Coffre et al.
4,936,877 A 6/1990 Hultquist
5,169,119 A * 12/1992 Duggal et al. ..... 251/74
5,197,710 A * 3/1993 Wass et al. ..... 251/129.15
5,230,359 A 7/1993 Ollivier
5,233,837 A 8/1993 Callahan ..... 62/606
5,289,690 A 3/1994 Rockenfeller et al. ..... 62/77
5,303,734 A 4/1994 Eidsmore ..... 337/305.43
5,409,526 A 4/1995 Zheng et al.
5,518,528 A 5/1996 Tom et al.
5,547,229 A 8/1996 Eidsmore ..... 285/93
5,566,713 A 10/1996 Lhomer et al.
5,595,209 A 1/1997 Atkinson et al. ..... 137/116.5
5,645,192 A 7/1997 Amidzich
5,673,562 A 10/1997 Friedt ..... 62/48.1
5,678,602 A 10/1997 Cannet et al.
5,685,159 A 11/1997 Kooy et al. ..... 62/50.1
5,692,381 A 12/1997 Garrett ..... 62/60
5,694,975 A 12/1997 Eidsmore ..... 137/489.5
5,752,544 A 5/1998 Yves ..... 137/461
5,762,086 A 6/1998 Ollivier ..... 137/1
5,901,557 A 5/1999 Grayson ..... 62/45.1
5,937,895 A 8/1999 LeFebre et al.
6,007,609 A 12/1999 Semerdjiian et al.
6,089,027 A 7/2000 Wang et al.
6,101,816 A 8/2000 Wang et al.

* cited by examiner

FLUID STORAGE AND DISPENSING SYSTEM FEATURING EXTERNALLY ADJUSTABLE REGULATOR ASSEMBLY FOR HIGH FLOW DISPENSING

BACKGROUND OF THE INVENTION

1. Field Of The Invention

This invention relates to a fluid storage and dispensing system that may be utilized to store high pressure liquid or gas, for dispensing of fluid from the system and use of the dispensed gas in an application such as the manufacture of semiconductor devices and materials.

2. Description of the Related Art

In a wide variety of industrial processes and applications, there is a need for a reliable source of process fluid(s).

For example, a safe, reliable and efficient fluid supply source is desirable in the field of semiconductor manufacturing, ion implantation, manufacture of flat panel displays, medical intervention and therapy, water treatment, emergency breathing equipment, welding operations, space-based delivery of liquids and gases, etc.

U.S. patent application Ser. No. 09/067,393 filed Apr. 28, 1998 in the names of Luping Wang and Glenn M. Tom describes a fluid storage and gas dispensing system including a storage and dispensing vessel for holding a fluid, e.g., a liquid at appropriate pressure whose vapor constitutes the fluid to be dispensed, or alternatively a compressed gas. The vessel includes an outlet port and is equipped with a dispensing assembly coupled to the outlet port, for example a valve head assembly including a dispensing valve and an outlet for selective discharge of gas deriving from liquid or compressed gas in the vessel.

In the Wang et al. system, a fluid pressure regulator is associated with the outlet port, and may be at least partially interiorly disposed in the vessel, optionally coupled with a phase separator assembly to prevent liquid from leaking to the dispensing valve and outlet when the fluid in the vessel is in the form of a liquefied gas. The fluid regulator preferably is fully interiorly disposed in the vessel, to minimize the possibility of impact and environmental exposure in use, and to minimize the leak path of the contained fluid from the vessel, so that a single weld or seam can be used at the outlet port, to seal the vessel.

The regulator is a flow control device, which can be set at a predetermined pressure level, to dispense gas or vapor from the cylinder at such pressure level. The pressure level set point may be superatmospheric, subatmospheric or atmospheric pressure, depending on the dispensing conditions, and the mode of gas discharge from the vessel.

U.S. patent application Ser. No. 09/300,994 filed Apr. 28, 1999 in the names of Luping Wang and Glenn M. Tom for "FLUID STORAGE AND DISPENSING SYSTEM," is a continuation in part of the above-described U.S. patent application Ser. No. 09/067,393, and describes further aspects of the "regulator in a bottle" apparatus, including arrangements employing a double-stage (or multi-stage) fluid pressure regulator, optionally with a particulate filter assembly, interiorly disposed in the vessel. Such continuation in part application also discloses fluid storage and dispensing vessel arrangements in which the vessel encloses an interior volume of less than about 50 liters and has an inlet opening larger than 1.5 inch NGT, as well as embodiments in which the fluid storage and dispensing vessel contains a physical adsorbent material holding adsorbed gas at an internal pressure of from about 50 psig to about 5000 psig.

In the practice of the regulator in a bottle system of the above-discussed U.S. patent application Ser. No. 09/300,994 and U.S. patent application Ser. No. 09/067,393, there is a need for further improvement in certain aspects of the structure and operation of the fluid storage and dispensing system.

More specifically, such fluid storage and dispensing systems with internally disposed regulator elements find use in a variety of gas supply applications, in which one or more "embedded" set pressure regulators (SPRs) each comprising a pressure sensing assembly (PSA) in the regulator body may be disposed in the interior volume of the storage and dispensing vessel, and utilized to regulate the pressure and flow rate of gas deriving from the contained fluid, in the fluid dispensing operation.

The ability to set the PSA of the embedded SPR to sub-atmospheric pressures, e.g., 600 Torr, is most desirable during installation and change-out of the vessel (involving coupling of the vessel to a gas dispensing flow circuit, or uncoupling of the vessel therefrom when the vessel has become depleted of fluid) or in other instances where a reliable vessel connection has not been made. For certain toxic hydride gases, it is also desirable to maintain a sub-atmospheric pressure setting during gas delivery to minimize the potential for catastrophic release during use. However, for many hydride gases, the main hazards of which are pyrophoricity or flammability, and for corrosive gases, a sub-atmospheric set point for the SPR will not allow for constant, high flow of dispensed gas to multiple points. In these instances, it is preferable to deliver these fluids at slightly positive pressures, once reliable vessel connections have been made. There are thus differing pressure levels that are appropriate or desirable for storage of fluid in the vessel as opposed to dispensing of fluid from the vessel.

The existing "regulator in a bottle" systems do not accommodate such desired differing set points for the regulator, since it is pre-set at a single set point prior to its installation in the vessel.

An additional issue accompanying the use of interiorly disposed regulator devices is the incidence of liquefaction and droplet condensation during the dispensing operation, as pressure on the compressed gas or liquefied compressed gas is reduced during flow thereof through the SPR.

Such liquefaction of liquefied compressed gases and liquid droplet formation from compressed gases attributable to pressure reduction is attributable to change in enthalpy of the fluid, in accordance with the well-known Joule-Thompson effect.

The incidence of the Joule-Thompson effect can limit flow conductance and capacity of the SPR, and degrade its performance and lifetime.

There is therefore a need in the art to provide improved fluid storage and delivery systems for selective dispensing of fluids that overcome the various deficiencies described above.

It is accordingly an object of the present invention to provide an improved fluid storage and dispensing system for selective dispensing of fluids, which overcomes such problems.

It is another object of the invention to provide a fluid storage and dispensing system that allows for sub-atmospheric SPR set-point pressure during storage and transportation and super-atmospheric SPR set-point pressure during use.

It is another object of the invention to provide an improved fluid storage and dispensing system for the selective dispensing of fluids, characterized by significant advantages in cost, ease of use, and performance.

Other objects and advantages of the invention will be more fully apparent from the ensuing disclosure and appended claims.

SUMMARY OF THE INVENTION

The present invention relates to a system for storage and dispensing of a fluid, for use in applications such as the manufacture of semiconductor products.

In one aspect, the present invention relates to a fluid storage and dispensing system, comprising:

a fluid storage and dispensing vessel enclosing an interior volume for holding a fluid, wherein the vessel includes a fluid discharge port for discharging fluid from the vessel;

a pressure regulating element in the interior volume of the fluid storage and dispensing vessel, arranged to flow fluid therethrough to the fluid discharge port at a set pressure for dispensing thereof; and a controller external of the fluid storage and dispensing vessel, arranged to transmit a control input into the vessel to cause the pressure regulating element to change the set pressure of the fluid flowed from the pressure regulating element to the fluid discharge port.

In another aspect, the invention relates to a fluid storage and dispensing system, comprising an enclosed vessel for holding a fluid, and a pressure monitoring assembly in the vessel including (i) a pressure sensor arranged for contact with fluid in the vessel, (ii) a piezoemitter operatively coupled with the pressure sensor and arranged to emit externally of the vessel a sonic signal correlative of pressure sensed by the pressure sensor, and (iii) a power supply operatively coupled with the pressure sensor.

A further aspect of the invention relates to a fluid storage and dispensing system, comprising:

a fluid storage and dispensing vessel enclosing an interior volume for holding a fluid, wherein the vessel includes a fluid discharge port for discharging fluid from the vessel;

an adjustable set point pressure regulator in the interior volume of the fluid storage and dispensing vessel, arranged to flow fluid therethrough to the fluid discharge port at a set point pressure for dispensing thereof; and a regulator adjustment assembly in the interior volume of the fluid storage and dispensing vessel, remotely controllable from outside of the vessel, and arranged to flow fluid from the interior volume of the vessel to the adjustable set point pressure regulator to change the set point pressure of the regulator.

Yet another aspect of the invention relates to a fluid storage and dispensing system, comprising:

a storage and dispensing vessel for holding a fluid and having a discharge port for dispensing fluid from the vessel;

a thermal controller for controlling temperature of fluid in the vessel;

a diffusion tube in the vessel, joined to the discharge port, and arranged for diffusion of fluid into the tube and flow from the tube to the discharge port for dispensing from the vessel;

a pressure sensor for sensing pressure of fluid dispensed from the vessel and operatively coupled with the thermal controller to selectively vary the temperature of the fluid in the vessel to correlatively vary diffusion of fluid into the diffusion tube and resultingly obtain a predetermined pressure in the fluid dispensed from the vessel.

One aspect of the invention relates to a method of supplying a fluid for use thereof, comprising:

confining a fluid in a fluid storage and dispensing vessel enclosing an interior volume for holding a fluid, wherein the vessel includes a fluid discharge port for discharging fluid from the vessel, and a pressure regulating element in the interior volume of the fluid storage and dispensing vessel, arranged to flow fluid therethrough to the fluid discharge port at a set pressure for dispensing thereof; and transmitting a control input from an exterior locus into the vessel to cause the pressure regulating element to change the set pressure of the fluid flowed from the pressure regulating element to the fluid discharge port.

A still further aspect of the invention relates to a method of monitoring fluid pressure in an enclosed vessel for holding a fluid, said method comprising sensing pressure of the fluid and transmitting within the vessel a signal correlative thereof to a piezoemitter within the vessel so that the piezoemitter transmits out of the vessel a sonic signal correlative of pressure sensed by the pressure sensor.

An additional aspect of the invention relates to a method of supplying fluid from a storage and dispensing vessel enclosing an interior volume for holding a fluid, and including a fluid discharge port for discharging fluid from the vessel, said method comprising:

disposing an adjustable set point pressure regulator in the interior volume of the fluid storage and dispensing vessel, arranged to flow fluid therethrough to the fluid discharge port at a set point pressure for dispensing thereof;

disposing a remotely actuatable fluid flow control assembly in the interior volume of the fluid storage and dispensing vessel, wherein the fluid flow control assembly is coupled in latent flow communication with the adjustable set point regulator; and remotely actuating the fluid flow control assembly to flow fluid from the interior volume of the vessel to the adjustable set point pressure regulator to change the set point pressure of the regulator.

Another aspect of the invention relates to a method of supplying fluid from a storage and dispensing vessel enclosing an interior volume for holding a fluid, and including a fluid discharge port for discharging fluid from the vessel, such method comprising:

disposing a diffusion tube in the vessel, joined to the discharge port, and arranged for diffusion of fluid into the tube and flow from the tube to the discharge port for dispensing from the vessel;

sensing pressure of fluid dispensed from the vessel; and varying the temperature of the fluid in the vessel in response to the sensed pressure, to correlatively vary diffusion of fluid into the diffusion tube to maintain a predetermined pressure in the fluid dispensed from the vessel.

Other aspects, features and embodiments in the invention will be more fully apparent from the ensuing disclosure and appended claims.

DETAILED DESCRIPTION OF THE INVENTION, AND PREFERRED EMBODIMENTS THEREOF

The disclosures of U.S. patent application Ser. No. 09/067,393 filed Apr. 28, 1998 in the names of Luping Wang and Glenn M. Tom for "FLUID STORAGE AND GAS DISPENSING SYSTEM," and U.S. patent application Ser. No. 09/300,994 filed Apr. 28, 1999 in the names of Luping Wang and Glenn M. Tom for "FLUID STORAGE AND DISPENSING SYSTEM," are hereby incorporated herein by reference in their entirety.

Figure 1:
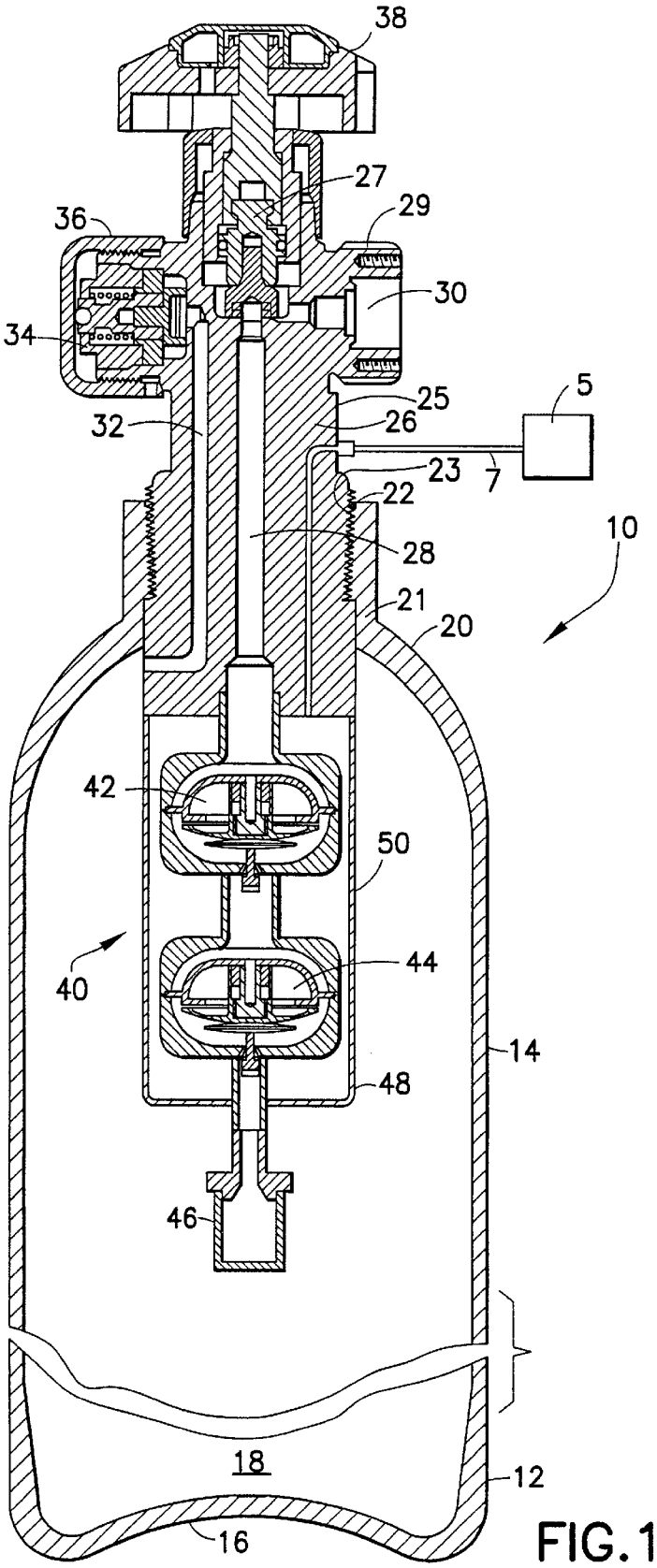
FIG. 1 is a schematic cross-sectional elevation view of a fluid storage and dispensing system according to one embodiment of the present invention.

Referring to the drawings, FIG. 1 is a schematic cross-sectional elevation view of a fluid storage and dispensing apparatus 10 according to one embodiment of the present invention.

The fluid storage and dispensing apparatus 10 features a storage and dispensing vessel 12 comprising a cylindrical sidewall 14 and a floor 16 corporately enclosing the interior volume 18 of the vessel. The side wall and floor may be formed of any suitable material of construction, e.g., metal, gas-impermeable plastic, fiber-resin composite material, combinations of materials such as nickel-lined carbon steel, etc., as appropriate to the gas to be contained in the vessel, the end use environment of the apparatus, and the pressure levels to be maintained in the vessel in storage and dispensing use.

At its upper end 20, the vessel features a neck 21 defining a port opening 22 bounded by the inner wall 23 of the neck 21. The inner wall 23 may be threaded or otherwise complementarily configured to matably engage therein a valve head 25 including a valve body 26 that may be complementarily threaded or otherwise configured for mating engagement with the inner wall 23.

In such manner, the valve head 25 is engaged with the vessel 12 in a leak-tight manner, to hold fluid therein in the interior volume 18 at the desired storage conditions.

The valve head body 26 is formed with a central vertical passage 28 therein for dispensing of gas deriving from fluid in the vessel 12. The central vertical passage 28 communicates with the gas discharge passage 30 of gas discharge port 29, as shown. The valve head body contains a valve element 27 that is coupled with the hand wheel 38, for selective manual opening of the valve to flow gas through the central vertical passage 28 to the gas discharge port 30, or alternatively manual closure of the valve to stop dispensing flow of gas from the central vertical passage 28 to the gas discharge port 30.

In place of the hand wheel valve actuation element, there may be provided an automatic valve actuator, such as a pneumatic valve actuator, an electromechanical valve actuator, or other suitable means for automatically opening and closing the valve in the valve head.

The valve head body 26 also contains a fill passage 32 formed therein to communicate at its upper end with a fill port 34. The fill port 34 is shown in the FIG. 1 drawing as capped by fill port cap 36, to protect the fill port from contamination or damage when the vessel has been filled and placed into use for the storage and dispensing of gas from the contained fluid.

The fill passage at its lower end exits the valve head body 26 at a side surface thereof as shown, so that when the fill port 34 is coupled with a source of the fluid to be contained in the vessel, the fluid can flow through the fill passage and into the interior volume 18 of the vessel 12.

Joined to the lower end of valve head body 26 is an embedded SPR assembly 40, comprising a first SPR element 44 and a second SPR element 42. The SPR elements are joined to one another in series, in flow communication with the gas discharge passage 30 as illustrated.

The SPR elements are contained in a housing 48 that is secured at its upper end to the lower end of the valve head body 26, e.g., by welding, brazing, adhesive bonding, or other suitable means and method. The housing 48 contains the SPR elements 44 and 42 in series relationship to one another, and the SPR elements are encapsulated in an encapsulant medium 50 in the interior volume of the housing.

At its lower end, the housing 48 is joined to a high efficiency particle filter 46, to prevent contamination of the SPR elements and upstream valve element 27 with particulates or other contaminating species that may be associated with the fluid flowed through the SPRs and valve in the operation of the apparatus. The apparatus may also have a second high efficiency particle filter (not shown in FIG. 1), disposed in the lower end of the valve head body 26, in the passage overlying the upper SPR 42.

The SPR elements may be initially set at respective pressure set points appropriate to the operation of the apparatus, with the first SPR 44 being set at a higher pressure than the second SPR 42.

In this embodiment, the SPR element(s) are arranged to be selectively heated to vary the set point pressure thereof. As shown in FIG. 1, the means for selectively heating the SPR assembly comprises a heating source 5 and a heating line 7 joining the heating source 5 with the encapsulant medium 50.

In a variant embodiment of the invention, the heating source 5 may comprise an electrical heating unit and line 7 may be an electrical cable coupled with the encapsulant medium 50, for resistively heating the encapsulant medium to in turn heat the SPR elements 42 and 44.

In another embodiment of the invention, the heating source 5 may comprise a reservoir of heated fluid and the line 7 may be a heat transfer fluid circulation line for flowing hot fluid through the encapsulant medium for selective heating thereof.

In yet another embodiment, the heating source 5 may be a laser and the line 7 may be an optical wave guide for conveying the laser energy to an encapsulant medium that is thermally excited by laser radiation incident thereon from the wave guide.

In still another embodiment of the invention, the heating source 5 may be a thermal unit and the line 7 may be a heat pipe thermally coupled at one end to the thermal unit and thermally coupled at the other end to the encapsulant medium.

It will be recognized that numerous other heating modalities, e.g., inductive heating, conductive heating, ultrasonic heating, infrared heating, exothermic chemical reaction heating, neutron capture heating, etc. may be variously employed in the broad practice of the present invention. Further, various heating means other than those specifically described herein, e.g., conductive means such as a heating blanket positioned on the shoulder of the vessel to warm the valve body and the set point regulator housing, or convective means involving fluid circulation, can be employed in the broad practice of the present invention.

When multiple SPRs are employed, each can be independently heated or otherwise independently thermally controlled to achieve separate control of the set pressure point thereof.

It will be further recognized that a variety of other alternative modalities for external control of the set pressure point of the SPR can be employed.

Figure 2:
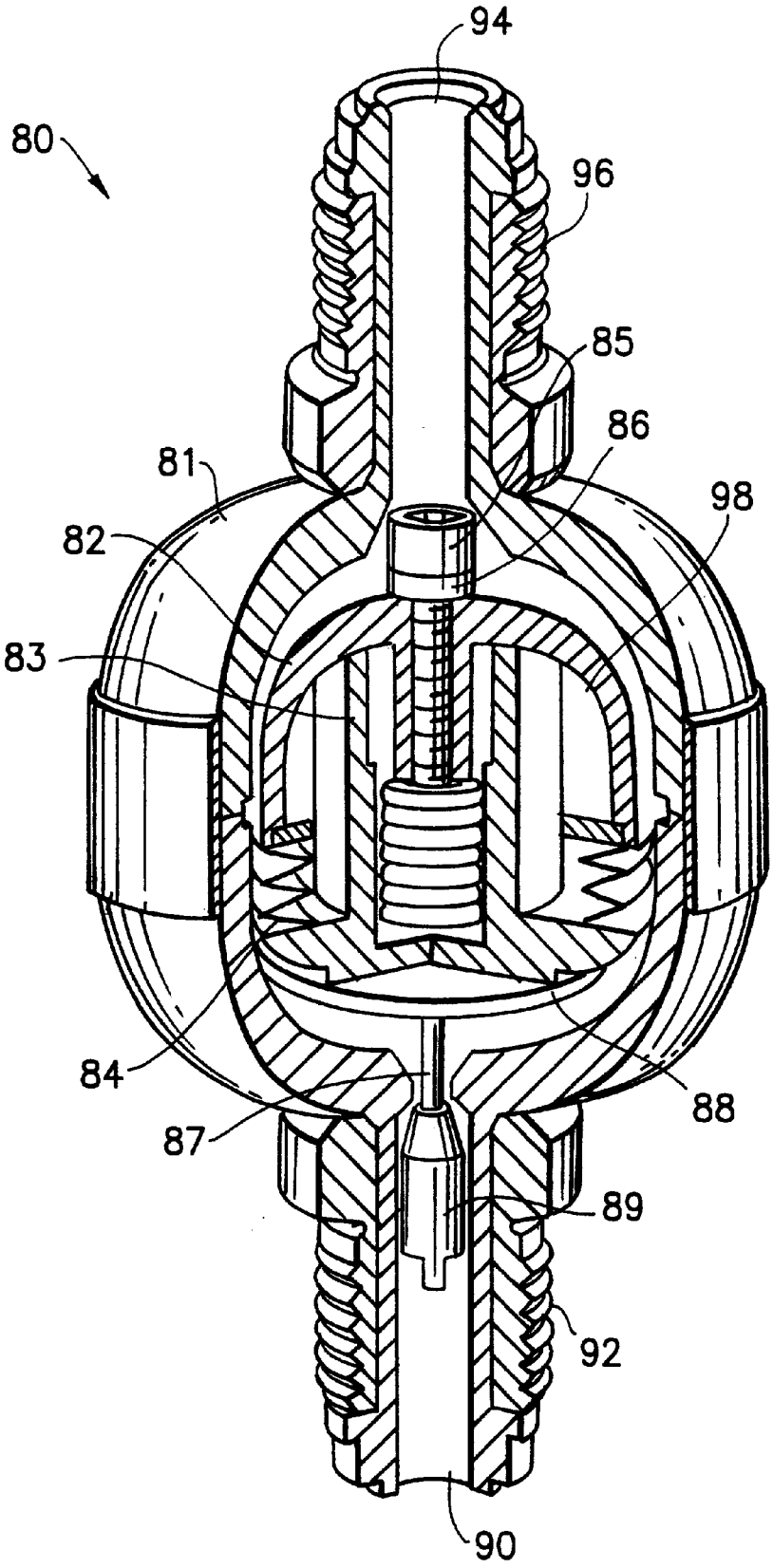
FIG. 2 is a perspective view, in partial section, of a gas pressure regulator of a type usefully employed in the practice of the invention.

FIG. 2 is a perspective view, in partial section, of a gas pressure regulator 80 of a type usefully employed in the practice of the invention. The gas pressure regulator 80 includes a regulator body 81 having an inlet 92 enclosing inlet fluid passage 90 and an outlet 96 enclosing outlet fluid passage 94, as shown. The inlet 92 and outlet 96 may be exteriorly threaded, as illustrated, to facilitate coupling of the regulator with a second regulator unit by an appropriate threaded collar or other fitting, or with other connecting structure.

The regulator 80 has a hollow interior volume in which is mounted a support housing 82 having face plate 83 and diaphragm element 84 coupled thereto. Threadably engaged in the support housing 82 is a fill screw 85, reposed on fill screw gasket 86. In the lower portion of the interior cavity of the regulator is a poppet-retaining wafer 88 having connected thereto the stem 87 of the poppet element 89.

The poppet element 89 is thus positioned in the inlet fluid passage 90. A poppet port seal (not shown in FIG. 2) may be positioned in the inlet fluid passage 90, to sealingly engage the poppet element 89 when the poppet element closes the inlet fluid passage 90 to fluid flow therethrough.

The regulator 80 thereby comprises a pressure sensing assembly in the cavity of the regulator body 81 comprising the diaphragm 84, support housing 82, face plate 83, wafer 88 and poppet element 89 and includes an interior volume 98 bounded by the diaphragm 84, support housing 82, and face plate 83.

The gas-actuated pressure sensing assembly (iSA) of the regulator 80 precisely controls outlet gas pressure. A slight increase in outlet pressure causes the PSA to contract, and a slight increase in the outlet pressure causes PSA expansion, with the contraction or expansion serving to vertically translate the poppet element 89 to provide precise pressure control.

The regulator element 80 used in the fluid storage and dispensing apparatus of the present invention may for example comprise a Swagelok HF series gas pressure regulator (commercially available from Swagelok Company, www.swagelok.com) accommodating inlet pressures up to 3000 psig and outlet pressures of 10 psig up to 150 psig, with flows up to 300 standard liters per minute (slpm).

In one embodiment, the regulator in the fluid storage and dispensing vessel is embedded in an encapsulant medium 50 (see FIG. 1) which may comprise any suitable high conductivity material, preferably a high conductivity metal such as aluminum, copper or stainless steel, or other material with suitable characteristics, e.g., having a thermal conductivity of at least 0.1 kcal/sec cm ° C., more preferably at least 0.3 kcal/sec cm ° C., and most preferably at least 0.4 kcal/sec cm ° C.

In a specific embodiment, such encapsulant medium may comprise a hybrid material comprising a high conductivity metal and dielectric material, to provide a composition affording independent temperature control of the gas surrounding the SPR and the external surface of the SPR itself. For example, the dielectric material may comprise a glass, a ceramic, cellulosic material, or the like.

The encapsulant medium 50 may also comprise a heat transfer fluid that is flowed through the housing 48, by means of a circulatory fluid arrangement (not shown) involving flow circuitry in the valve head body 26 that is coupleable to a source of heat transfer fluid for circulation of the fluid through the flow circuit and the housing 48. The heat transfer fluid may be water, a polyol or glycol, a silicone oil, or other suitable fluid.

As a still further alternative, the encapsulant medium may comprise an electrical resistance heating structure in the housing, for heating the SPRs and surrounding gas.

As a further aspect of the invention, in addition to, or in lieu of, the provision of the encapsulant medium 50, the PSA of the SPR may contain fluids, solids or fluids adsorbed on solids, the vapor pressures of which can be selected to produce appropriate pressures in the PSA at varying temperatures.

The fluid can be the same fluid as is being dispensed from the vessel in normal dispensing operation thereof, e.g., arsine, phosphine, boron trifluoride, boron trichloride, etc. The solid can be a solid capable of sublimation at it is heated to provide a vapor phase of desired pressure characteristic in the interior volume of the PSA, such as an organometallic reagent. The solids having the fluid sorbed thereon may comprise any suitable sorbent material having sorptive affinity for an associated gas. Examples of sorbent materials suitable for such purpose include molecular sieve (zeolite) materials, silica, alumina, macroreticulate resins, carbon (e.g., activated carbon), etc., having suitable sorptive affinity for the gas of interest, such as the gases mentioned illustratively in the preceding sentence.

Thus, referring to FIG. 2, the interior volume 98 may contain the fluid, solid or fluid adsorbed on a solid that satisfies the desired pressure criteria for adjustability of the set point of the SPR(s). For example, a fluid, sublimable solid or fluid-retaining solid may be deployed in the interior volume 98 of an SPR to provide a pressure of 400–700 Torr at a temperature of 70–90° C. and a vapor pressure of 1000–3000 Torr with an increase of temperature of 30–50° C. (above the original temperature level of 70–90° C.).

In one aspect, the invention contemplates encapsulating one or more SPRs in series with a high conductivity metal, e.g., aluminum or stainless steel, such that either the metal or a fluid in an annular space between the encapsulating metal and exterior of the SPR conducts heat to the SPRs and to the gas surrounding the SPRS. The heating mechanism can be based upon the resistivity of the metal, circulation of a heat transfer fluid, etc. Additionally, the PSA(s) of the SPR(s) will contain fluids, solids, or fluids adsorbed on solids to provide the desired pressure in the PSA at a given imposed temperature condition.

By heating the SPRs in this manner, the following advantages are realized:

(1) The set-point pressure of the SPR can be adjusted to provide a positive pressure gas delivery in the operational mode, with the set-point pressure of the SPR being maintained at <1 atm during storage and shipping. The set-point pressure can be adjusted without mechanically altering the regulating device, which is not possible with embedded spring-loaded regulators.

(2) Improved heat transfer of gases both external to and within the SPR is readily enabled, to achieve constant, high flow of gases through the embedded SPRS.

(3) The adverse occurrences of liquefaction and liquid droplet formation incident to pressure reduction of the gas being dispensed is minimized or eliminated.

Considering the fluid storage and dispensing apparatus and method in greater detail, the fluid in the fluid storage and dispensing vessel may be any suitable fluid medium at any appropriate fluid storage conditions, e.g., a high pressure gas or alternatively a liquid, at the set point pressure determined by the fluid pressure regulator element(s), as the source of the gas to be dispensed. Thus, the gas source in the system may be a high-pressure gas or a liquefied gas.

The fluid utilized in the fluid storage and dispensing vessel of the invention may for example comprise a hydride fluid for semiconductor manufacturing operations.

Examples of hydride fluids of such type include arsine, phosphine, stibine, silane, chlorosilane, and diborane. Other fluids useful in semiconductor manufacturing operations may be employed, including acid gases such as hydrogen fluoride, boron trichloride, boron trifluoride, hydrogen chloride, halogenated silanes (e.g., $SiF_4$) and disilanes (e.g., $Si_2F_6$), etc., having utility in semiconductor manufacturing operations as halide etchants, cleaning agents, source reagents, etc.

Although the storage and dispensing vessel 12 shown in FIG. 1 is illustrated as being in an empty condition in the interior volume 18, prior to filling of the vessel with the fluid to be dispensed, it will be appreciated that the vessel can contain sorbent material(s) to remove impurities or contaminants from the fluid being stored in the vessel, or to sorptively retain the fluid being stored, for subsequent release (desorption) in the dispensing operation. Sorbent-containing vessels of such type are commercially available from Advanced Technology Materials, Inc. (Danbury, Connecticut) under the trademark VAC-SORB.

Further, while the FIG. 1 embodiment illustratively shows two SPRs in series, it will be appreciated that a lesser number (i.e., one) or a greater number of SPRs can be used.

The various features and aspects illustratively disclosed herein can be utilized separately or in various permutations or combinations with one another, to provide a fluid storage and dispensing system constituting a useful source fluid apparatus for specific usage requirements.

The present invention therefore contemplates a variety of means and methods for externally effecting the adjustment of a set point of an adjustable set pressure regulator, as will be better appreciated from the ensuing embodiments.

As a further example of a system arrangement for such external adjustment of the regulator, a magnetically induced valve change could be effected by an electromagnet placed outside the vessel in the vicinity of the regulator/valve assembly. The magnetic field can be used to change the state of the valve and/or the regulator.

Figure 3:
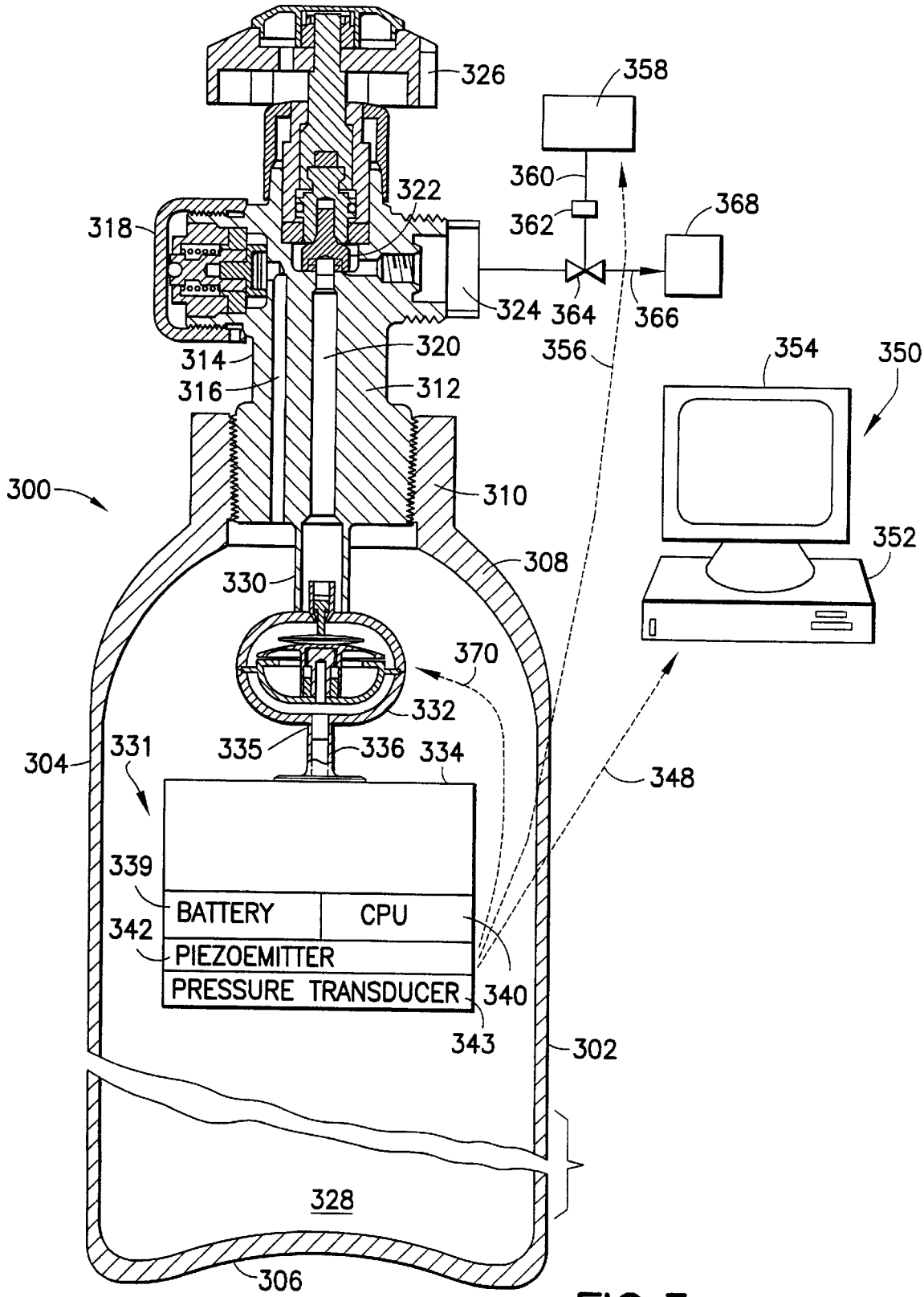
FIG. 3 is a schematic cross-sectional elevation view of a fluid storage and dispensing system according to another embodiment of the present invention.

FIG. 3 is a schematic cross-sectional elevation view of a fluid storage and dispensing system 300 according to one illustrative embodiment of the present invention. The system 300 includes a fluid storage and dispensing vessel 302 of generally cylindrical form, with cylindrical side wall 304 closed at its lower end by floor member 306. At the upper end of the vessel is a neck 308 including a cylindrical collar 310 defining and circumscribing a top opening of the vessel. The vessel wall, floor member and neck thereby enclose an interior volume 328 as shown.

At the neck of the vessel, a threaded plug 312 of the valve head assembly 314 is threadably engaged with the interior threaded opening of the collar 310. The valve head assembly 314 includes a central fluid flow passage 320 joined in fluid flow communication with a central working volume cavity in the valve head assembly. The central working volume cavity is in turn joined to outlet 324, which may be exteriorly threaded or otherwise constructed for attachment of a connector and associated piping, conduit, etc. thereto.

A gas discharge conduit 366 is shown in FIG. 3 as having valve 364 disposed therein, for control of flow of dispensed gas through the conduit. The conduit 366 in turn is joined in gas supply relationship to a semiconductor manufacturing facility 368 or other downstream gas-consuming process facility.

Disposed in the central working volume cavity is a valve element 322 that is joined to a hand wheel 326 in the embodiment shown, but can alternatively be joined to an automatic valve actuator or other controller or actuating means.

The valve head assembly 314 also features in the valve block a flow passage 316 joined to a fill port capped with a cap 318 and communicating with the interior volume 328 of the vessel, for introduction of fluid (e.g., compressed liquid and/or gas) into the vessel.

The central fluid flow passage 320 in the valve head assembly 314 is joined at its lower end to a connector flow tube 330, to which in turn is joined to the regulator 332. The regulator is set to maintain a selected pressure of the fluid discharged from the vessel. At the lower end of the regulator is joined a tubular fitting 335 containing fluid inflow openings 336 through which the high pressure fluid enters the regulator structure from tubular fitting 335.

The tubular fitting 335 in turn is joined, e.g., by butt welding, to a piezoelectric pressure monitoring unit 331 including a housing 334 containing a battery 339, a central processor unit (CPU) 340, a piezoemitter 342 and a pressure transducer 343 as schematically shown. The battery, CPU, pressure transducer and piezoemitter components are operatively arranged for monitoring the pressure of the fluid in the interior volume 328 of the vessel.

The piezoelectric pressure monitoring unit serves as an interiorly disposed "fuel gauge" for the vessel 302, and is hermetically sealed from the fluid contents of the vessel except for the pressure transducer 343 that is exposed to the fluid and produces a signal related to the pressure of the fluid in the vessel 302. The pressure sensing surface of the transducer can be formed of stainless steel or other compatible material with respect to the fluid being contained in and dispensed from the vessel 302.

The battery 339 is of a size, power rating and operating life for satisfactory operation in the system. The life/power characteristics of the battery are advantageously sufficiently high to last between valve changeouts, e.g., a period of five years if hydrotesting is employed to determine the changeout frequency. The battery powers all the internal components of the pressure monitoring unit 331 and may be rechargeable by heat or vibration.

The CPU 340 is used to drive the system and in one embodiment comprises circuitry to "read" the pressure transducer 343. Features such as incorporation of a "sleep" function are usefully employed to maximize battery life. A PIC-type microprocessor (proportional integrating controller) is advantageously employed as having low power, low cost and adequate feature set characteristics.

The output of the pressure transducer is outputted as an audio signal on the piezoemitter 342. These sound waves are transmitted through the wall 304 of the vessel 302 to the exterior environment of the vessel.

An external microphone is advantageously employed to detect the sonic signal from the piezoemitter. Such arrangement avoids any penetrative or invasive means or action in the monitoring of the fluid pressure in the vessel 302.

The sonic signal from the piezoemitter 342 can be transmitted in any of various suitable formats, as desired in a given end use application. For example, the data can be in serial format, and include detailed information on system variables such as pressure of the fluid in the vessel, battery condition, etc. A temperature transducer may be employed as a component of the monitoring unit 331, to provide data concerning internal temperature of the vessel and its fluid contents.

As a variation of the system shown in FIG. 3, the system in one embodiment includes an input microphone, so that the internal pressure transducer can receive commands from a locus exterior of the vessel. The input microphone could be the same as the piezoemitter element.

By means of the piezoemitter signal indicative of the pressure condition in the interior volume 328 of the vessel 302, the system can be controllably operated in various modes.

In one embodiment, shown with reference to FIG. 3, the piezoemitter signal 348 can be transmitted to an output microphone associated with a computer terminal 350 comprising computer terminal CPU 352 and monitor 354, with the monitor displaying an output pressure value, by algorithmic processing of the sonic signal from the piezoemitter 342.

Alternatively, or additionally, a sonic signal 356 from the piezoemitter 342 is detected by a sensor (output microphone) that responsively actuates valve actuator 362 by output control signal transmitted in signal transmission line 360 to modulate the valve 364, so that the flow is correspondingly adjusted. This arrangement, for example, can be used to modulate the flow rate and/or to close the valve when the pressure transducer 343 senses a low pressure condition indicating that the vessel is nearing an empty state, so that the flow is decreased or terminated, to accommodate transition and change-out of the fluid storage and dispensing vessel.

Additionally, or alternatively, an actuating signal can be generated at the computer 350 and transmitted therefrom to the piezoemitter 342, opposite to the direction indicated by signal 348, and the actuated piezoemitter could be coupled to regulator 332, which for such purpose is an adjustable set point regulator, to adjust the set point pressure of the regulator. Such coupling of the piezoemitter to the regulator 332 is schematically shown in FIG. 3 by the connecting arrow 370. As a further modification, the piezoemitter element may be replaced by a piezoelectric element that is actuated remotely from outside the vessel 302 to effect adjustment of the set point pressure of the regulator 302.

In use, a suitable fluid reagent is contained in the interior volume 328 of the vessel 302, e.g., a high pressure gas or a liquefied gas, or alternatively a sorbable gas sorptively retained on a physical sorbent having sorptive affinity for the gas, wherein the interior volume contains a bed of suitable solid-phase physical sorbent material. The fluid pressure regulator 332 is set to a selected set point to provide flow of dispensed fluid when the valve in the valve head assembly 314 is opened, with the fluid flowing through the fluid inflow openings 335, tubular fitting 336, regulator 332, connector flow tube 330, central fluid flow passage 320 in the valve head assembly 314, the central working volume cavity, and outlet 324 to line 366.

In the remote pressure sensing mode first describing, the computer 350 may be arranged for cyclic polling of the monitoring unit 331, to determine the pressure in the vessel 302 at a selected frequency or time interval, and with extrapolative algorithms being employed to determine the time of exhaustion of the contents of the vessel, as a function of the amount of fluid previously withdrawn from the vessel, or at a constant flow rate corresponding to a fixed setting of valves 322 and 364.

Figure 4:
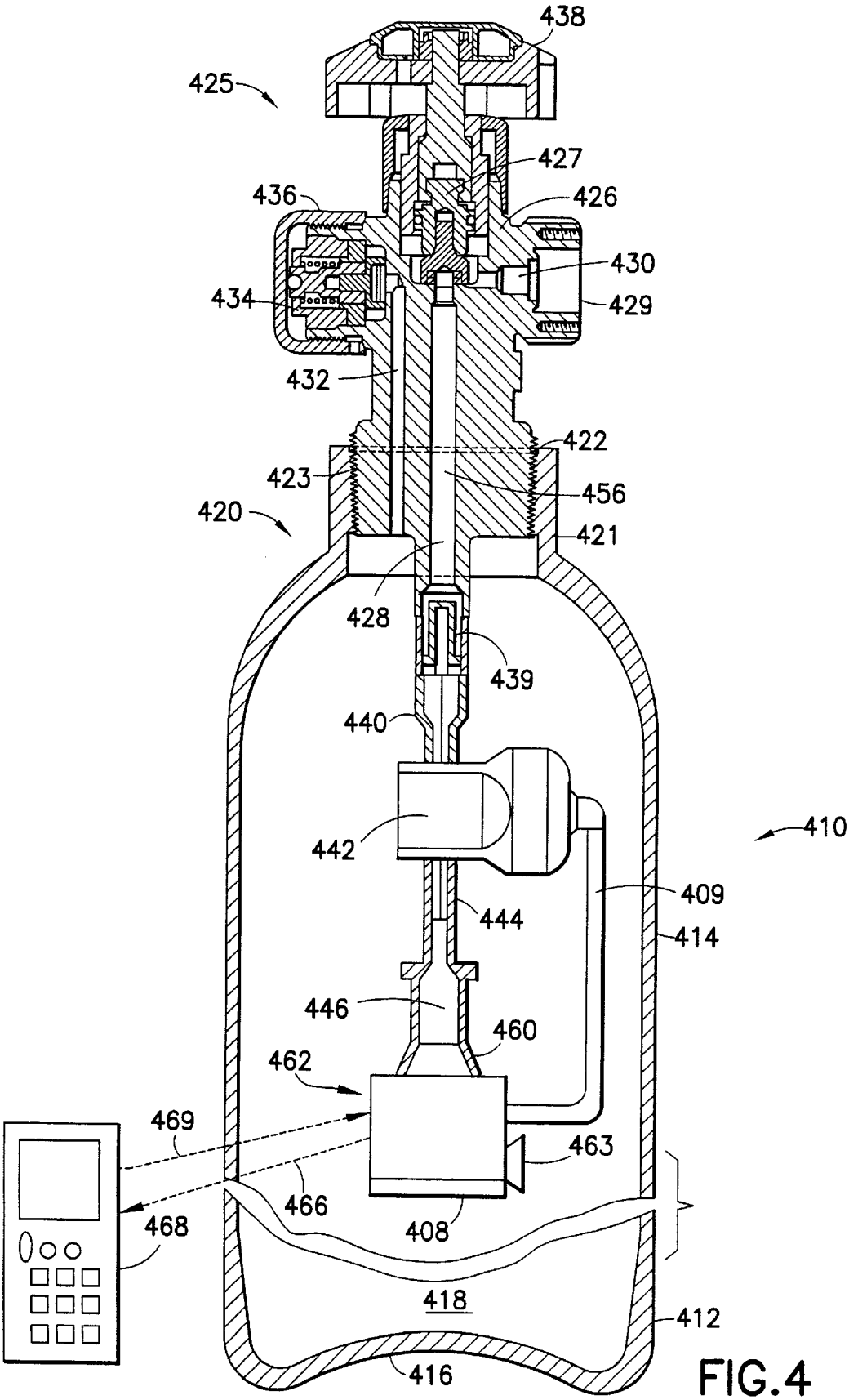
FIG. 4 is a schematic cross-sectional elevation view of a fluid storage and dispensing system according to yet another embodiment of the present invention.

FIG. 4 is a schematic cross-sectional elevation view of a fluid storage and dispensing apparatus 410 according to one embodiment of the present invention.

The fluid storage and dispensing apparatus 410 features a storage and dispensing vessel 412 comprising a cylindrical sidewall 414 and a floor 416 corporately enclosing the interior volume 418 of the vessel. The side wall and floor are formed of any suitable material of construction, as appropriate to the gas to be contained in the vessel, the end use environment of the apparatus, and the pressure levels to be maintained in the vessel in storage and dispensing use.

At its upper end 420, the vessel features a neck 421 defining a port opening 422 bounded by the inner wall 423 of the neck 421. The inner wall 423 may be threaded or otherwise complementarily configured to matably engage therein a valve head 425 including a valve body 426 that may be complementarily threaded or otherwise configured for mating engagement with the inner wall 423.

In such manner, the valve head 425 is engaged with the vessel 412 in a leak-tight manner, to hold fluid therein in the interior volume 418 at the desired storage conditions.

The valve head body 426 is formed with a central vertical passage 428 therein for dispensing of gas deriving from fluid in the vessel 412. The central vertical passage 428 communicates with the gas discharge passage 430 of gas discharge port 429, as shown. The valve head body contains a valve element 427 that is coupled with the hand wheel 438, for selective manual opening of the valve to flow gas through the central vertical passage 428 to the gas discharge port 429, or alternatively manual closure of the valve to stop dispensing flow of gas from the central vertical passage 428 to the gas discharge port 429. The valve element 427 is therefore arranged downstream of the regulator, so that fluid dispensed from the vessel flows through the regulator prior to flow through the flow control valve comprising valve element 427.

In place of the hand wheel valve actuation element, there may be provided an automatic valve actuator, such as a pneumatic valve actuator, an electromechanical valve actuator, or other suitable means for automatically opening and closing the valve in the valve head.

The valve head body 426 also contains a fill passage 432 formed therein to communicate at its upper end with a fill port 434. The fill port 434 is shown in the FIG. 4 drawing as capped by fill port cap 436, to protect the fill port from contamination or damage when the vessel has been filled and placed into use for the storage and dispensing of gas from the contained fluid.

The fill passage at its lower end exits the valve head body 426 at a bottom surface thereof as shown, so that when the fill port 434 is coupled with a source of the fluid to be contained in the vessel, the fluid can flow through the fill passage and into the interior volume 418 of the vessel 412.

Joined to the lower end of valve head body 426 is an extension tube 440, optionally containing a first particle filter 439 in its upper portion, and at its lower end 444 being joined to high efficiency particle filter 446. An adjustable pressure regulator 442 is mounted on the extension tube 440 as shown. The adjustable pressure regulator 442 may be of any suitable type that provides an adjustable set point pressure, e.g., a Swagelock HFD3B regulator, commercially available from Swagelock Company (Solon, Ohio).

The high efficiency particle filter 446 at the lower end 444 of the extension tube 440 serves to prevent contamination of the regulator elements and upstream valve element 427 with particulates or other contaminating species that may be associated with the fluid flowed through the regulator and valve in the operation of the apparatus. The apparatus may also have the optional high efficiency particle filter 439 disposed in the upper portion of the extension tube to provide further particulate removal capability, to ensure high gas purity of the dispensed gas. Preferably, the regulator has at least one particle filter in series flow relationship with the regulator, e.g., upstream as well as downstream of the regulator in the fluid flow path from the vessel interior volume to the fluid dispensing assembly joined to the valve head of the apparatus.

The pressure set point adjustment assembly 462 for the regulator 442 is joined to the lower end of particle filter 446 by an interconnecting conical transition section 460. The conical transition section at its upper end is welded, brazed or otherwise connected to the particle filter, and at its lower end is welded, brazed or otherwise connected to the pressure set point adjustment assembly 462.

The pressure set point adjustment assembly 462 includes a fluids adjuster in the housing of the assembly that is actuatable to introduce fluid from the interior volume 418 of the vessel 412 into the assembly housing through the intake 463. In the housing, the high pressure fluid from the interior volume is flowed through a flow controller valve therein (not shown in FIG. 4) and discharged from the housing into the adjustment fluid conduit 409. From the conduit 409, the high pressure fluid flows to the adjustable pressure set point regulator and effects adjustment of the pressure set point of the regulator.

In this manner, the pressure set point adjustment assembly 462 serves as a pneumatic controller for the regulator 442. The regulator thus is fluidically adjustable as to its set point pressure. The pressure set point adjustment assembly 462 is actuatable by means of the remote control unit 468 which generates a control signal 469, e.g., a sonic signal, radio frequency signal, or other signal. The signal 469 is transmitted to the pressure set point adjustment assembly 462 and actuates the controller.

The pressure set point adjustment assembly 462 is usefully employed in a dual set point mode. As mentioned earlier herein, the ability to set the PSA of the embedded SPR to sub-atmospheric pressures, e.g., 600 Torr, is most desirable during installation and change-out of the vessel or in other instances where a reliable vessel connection has not been made, but it is subsequently necessary to deliver the contained fluid at higher, positive pressures, once reliable vessel connections have been made. These differing pressure levels for storage of fluid in the vessel (at low regulator set point pressure) and dispensing of fluid from the vessel (at higher regulator set point pressure) is readily accommodated by a "two-point" pressure adjustment arrangement of the apparatus illustratively shown in FIG. 4.

In such two-point arrangement, the pressure regulator is pre-set at a low (e.g, subatmospheric pressure or near-atmospheric pressure) set point during fabrication of the system, so that the regulator retains such low pressure set point during storage and transport, as well as installation of the fluid supply vessel in the end use facility.

Then, when the vessel has been installed in the end use facility and reliable connections to the vessel have been made, and the vessel is ready for higher set point pressure dispensing, at the second (e.g., superatmospheric) pressure set point, the pressure set point adjustment assembly 462 is "tripped" by the remote unit 468. The remote unit 468 is actuated and transmits control signal 469 to the pressure set point adjustment assembly 462.

The "tripped" pressure set point adjustment assembly 462 then opens a valve in the assembly (not shown in FIG. 4) to allow flow of high pressure fluid, from the bulk fluid mass in the interior volume 418, into the fluid inlet 463. From the fluid inlet 463, the high pressure fluid flows through the assembly 462 and into the adjustment fluid conduit 409 to adjust the set point pressure of the regulator 442 to the higher set point pressure needed in the subsequent dispensing operation.

The foregoing two-point arrangement permits a simple apparatus configuration to be achieved, in which the high pressure fluid in the vessel 412 is used as the "working fluid" for the adjustment of the set point pressure setting of the adjustable set point regulator.

Other arrangements can be employed in which the high pressure of the fluid in the vessel is used to vary the pressure set points of the regulator 442 over pressure set point values in a range, e.g., by throttling of the high pressure fluid flow taken into the pressure set point adjustment assembly 462 through inlet 463.

In such manner, the regulator set point adjustment fluid flowed to the regulator in adjustment fluid conduit 409 can be adjusted in pressure (throttled down) in pressure set point adjustment assembly 462 and then flowed in conduit 409 to adjust the regulator to a desired higher pressure set point than is employed during the storage, transport and pre-dispensing state of the fluid storage and dispensing vessel.

Concurrently, the pressure of the fluid in the interior volume of the vessel may be monitored by means of the pressure transducer 408 of the pressure set point adjustment assembly 462, arranged as previously described in connection with the illustrative embodiment of FIG. 3. The pressure transducer sensing then is transmitted by the pressure set point adjustment assembly 462 as output signal 469, e.g., a sonic signal, radio frequency signal, or other signal, to the remote unit 468 for visual outputting on the screen of the remote unit. Such arrangement permits real-time monitoring of the internal pressure of the fluid in the vessel.

In a typical configuration of the fluid storage and dispensing vessel of FIG. 4, a gas discharge line, containing a flow control valve therein, will be coupled with the discharge port 429 and the flow control valve in the gas discharge line (not shown in FIG. 4) will be opened to flow gas from the vessel 412 to the associated process facility (e.g., a semiconductor manufacturing facility or other use facility), in the dispensing mode of the fluid storage and dispensing system 410. The gas dispensed in such manner will be at a pressure determined by the set point of the regulator 442.

After the fluid in the vessel 412 is consumed, the pressure set point of the regulator can again be reduced to sub-atmospheric pressure by appropriate adjustment signal from remote unit 468 to the pressure set point adjustment assembly 462, so that the fluid vessel can be disconnected from the connecting flow circuitry with a discharge pressure below ambient, thereby eliminating the possibility of high pressure release of fluid from the vessel at it is uncoupled from the flow circuitry.

Alternatively, reduction of the pressure set point of the regulator to a sub-atmospheric pressure can be effected by allowing ingress of fluid from the bulk fluid volume (through inlet 463 in pressure set point adjustment assembly 462) and flowing it through a venturi passage (not shown) in the pressure set point adjustment assembly 462, to exert a vacuum or suction on the adjustment fluid conduit 409. This imposition of vacuum is thus effected to reestablish the subatmospheric pressure set point condition of the regulator in a manner that uses the bulk fluid in the interior volume 418 of the vessel as a "working fluid" to adjust the regulator set point.

The ability to adjustably set the pressure setting of the interiorly disposed regulator may be employed in one embodiment of the invention to eliminate the need for a separate fill port on the valve body 426. With the regulator being adjustable in set point pressure level, the regulator 442 can be set at very high pressure to allow high pressure fluid to be filled into storage and dispensing vessel 412 through the discharge port 429 in the valve body 426. After filling, the regulator set point can be reduced to the desired level for safety.

Figure 5:
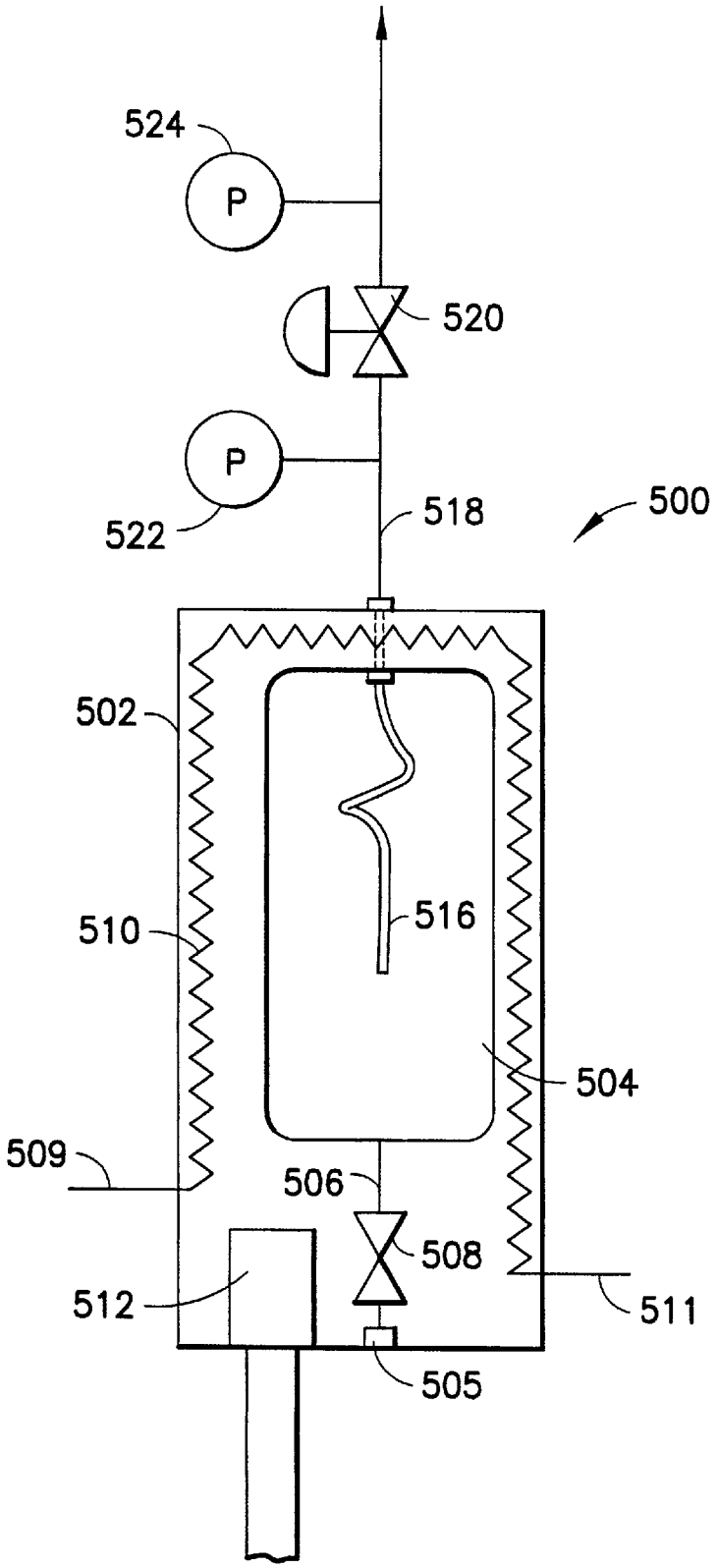
FIG. 5 is a schematic cross-sectional elevation view of a fluid storage and dispensing system according to a further embodiment of the present invention.

FIG. 5 is a schematic cross-sectional elevation view of a fluid storage and dispensing system 500 according to a further embodiment of the present invention.

The fluid storage and dispensing system 500 includes a thermal control enclosure 502 defining a vessel therein in an interior volume 504. Such interior volume is filled with the fluid to be stored and subsequently dispensed, by means of the fill port 505 including flow line 506 containing flow control valve 508 therein.

The thermal control enclosure 502 is equipped with a heating element 510, such as a resistance heating element whose ends 509 and 511 are joined to a source (not shown) of electrical energy that is controllable to effect the desired elevated temperature conditions in the interior volume 504 containing the fluid to be dispensed.

The thermal control enclosure 502 is also equipped with a chiller 512, such as a vortex chiller or other cooling or refrigeration device, arranged to selectively cool the thermal control enclosure 502 to a desired low temperature.

In this manner, the thermal control enclosure has associated heating and cooling capability associated therewith, so that the fluid in the interior volume 504 is able to be selectively heated or cooled to a desired temperature condition.

Disposed in the interior volume 504 is a permeation tube 516 that is closed at its lower end in the view shown. The permeation tube 516 is constructed of a material that is permeable to the fluid held in the interior volume 504. Permeation tubes are readily commercially available and are described for example in U.S. Pat. No. 4,936,877 issued Jun. 26, 1990 to Steven J. Hultquist and Glenn M. Tom.

The diffusion tube 516 is joined exteriorly of the thermal control enclosure 502 to a fluid discharge line 518 having flow control valve 520 therein, and optionally pressure monitoring transducer 522 upstream of valve 520 and/or pressure monitoring transducer 524 downstream of valve 520, to monitor the pressure in the discharge line at such upstream and/or downstream point(s).

The diffusional flux of fluid into the diffusion tube 516 is determined by system variables including the surface area of the diffusion tube, the thickness of the tube wall, the temperature of the tube, the temperature of the fluid contacting the diffusion tube and the pressure of the fluid contacting the diffusion tube.

The surface area of the tube (wall area available for diffusion therethrough) and the thickness of the tube are fixed and highly stable in character, typically having a variation of less than about 1% per year.

The temperature and pressure of the fluid (and temperature of the diffusion tube in contact with the fluid) in the interior volume 504 are selectively variable over wide ranges by selective operation of the heater and cooler elements of the system, so correspondingly vary the flux of fluid into the diffusion tube over a correspondingly large range.

The system can therefore be operationally arranged with pressure transducers 522 and/or 524 coupled to the heating/cooling means to form a feedback loop, so that pressure in the discharge line 518 can be selectively adjusted to a desired value by correlative heating or cooling of the thermal control enclosure 504 to correspondingly heat or cool the fluid in the interior volume 504 and achieve a flux of fluid into the diffusion tube providing the desired fluid pressure characteristics in discharge line 518.

For such purpose, the pressure transducers 522 and 524 are appropriately coupled to a control unit (not shown) which is linked to the heater and cooler components to maintain the operation of dispensing fluid at a desired pressure.

It will therefore be appreciated that the fluid storage and dispensing system of the invention can be configured and arranged in various structural and operational forms, to achieve desired pressure characteristics of fluid dispensed from the fluid storage and dispensing vessel, by external control of the interior operation of the fluid storage and dispensing vessel.

Thus, while the invention has been illustratively described herein with reference to specific elements, features and embodiments, it will be recognized that the invention is not thus limited in structure or operation, but that the invention is to be broadly construed consistent with the disclosure herein, as comprehending variations, modifications and embodiments as will readily suggest themselves to those of ordinary skill in the art.

What is claimed is:

1. A fluid storage and dispensing system, comprising:

a fluid storage and dispensing vessel enclosing an interior volume for holding a fluid, wherein the vessel includes a fluid discharge port for discharging fluid from the vessel;

a pressure regulating element in the interior volume of the fluid storage and dispensing vessel, arranged to flow fluid therethrough to the fluid discharge port at a set pressure for dispensing thereof; and a controller external of the fluid storage and dispensing vessel, arranged to transmit a control input into the vessel to cause the pressure regulating element to change the set pressure of the fluid flowed from the pressure regulating element to the fluid discharge port.

2. A system according to claim 1, wherein the pressure regulating element comprises an adjustable set point pressure regulator.

3. A system according to claim 1, wherein the pressure regulating element comprises a diffusion tube.

4. A system according to claim 1, wherein the control input comprises a thermal energy input.

5. A system according to claim 4, wherein the thermal energy input comprises a heated fluid.

6. A system according to claim 1, wherein the control input comprises an electromagnetic energy input.

7. A system according to claim 1, wherein the control input comprises a laser input.

8. A system according to claim 1, wherein the control input comprises a radio frequency signal.

9. A system according to claim 1, wherein the control input comprises a sonic input.

10. A system according to claim 1, wherein the control input comprises a fluidic input.

11. A system according to claim 9, wherein the fluidic input comprises a fluid supplied externally of the fluid storage and dispensing vessel.

12. A system according to claim 9, wherein the fluidic input comprises fluid contained in the interior volume of the vessel.

13. A system according to claim 1, wherein the control input comprises one or more thermal input(s) selected from the group consisting of inductive heating, conductive heating, ultrasonic heating, infrared heating, exothermic chemical reaction heating, and neutron capture heating.

14. A system according to claim 1, wherein the control input comprises convective heating.

15. A system according to claim 1, wherein the controller comprises a programmable computer.

16. A system according to claim 1, wherein the controller comprises a remote control unit that is manually actuatable.

17. A system according to claim 1, wherein the pressure regulating element comprises an array of adjustable set point pressure regulators.

18. A system according to claim 17, wherein each of the adjustable set point pressure regulators is independently controllable.

19. A system according to claim 1, further comprising an internal fluid pressure sensing and output signal generating assembly in the interior volume of the vessel.

20. A system according to claim 19, wherein the internal fluid pressure sensing and output signal generating assembly transmits a pressure sensing signal externally of the vessel.

21. A system according to claim 20, further comprising an external receiver for receiving said pressure sensing signal and displaying pressure information indicative of fluid pressure in the interior volume of the vessel.

22. A system according to claim 1, further comprising a fluid in the interior volume of the vessel.

23. A system according to claim 22, wherein the fluid is selected from the group consisting of compressed liquefied gases and compressed gases.

24. A system according to claim 22, wherein the fluid includes at least one component selected from the group consisting of arsine, phosphine, stibine, silane, diborane, hydrogen fluoride, boron trichloride, boron trifluoride, hydrogen chloride, halogenated silanes and disilanes.

25. A fluid storage and dispensing system, comprising an enclosed vessel for holding a fluid, and a pressure monitoring assembly in the vessel including (i) a pressure sensor arranged for contact with fluid in the vessel, (ii) a piezoemitter operatively coupled with the pressure sensor and arranged to emit externally of the vessel a sonic signal correlative of pressure sensed by the pressure sensor, and (iii) a power supply operatively coupled with the pressure sensor.

26. A fluid storage and dispensing system, comprising:

a fluid storage and dispensing vessel enclosing an interior volume for holding a fluid, wherein the vessel includes a fluid discharge port for discharging fluid from the vessel;

an adjustable set point pressure regulator in the interior volume of the fluid storage and dispensing vessel, arranged to flow fluid therethrough to the fluid discharge port at a set point pressure for dispensing thereof; and a regulator adjustment assembly in the interior volume of the fluid storage and dispensing vessel, remotely controllable from outside of the vessel, and arranged to flow fluid from the interior volume of the vessel to the adjustable set point pressure regulator to change the set point pressure of the regulator.

27. A method of supplying a fluid for use thereof, comprising:

confining a fluid in a fluid storage and dispensing vessel enclosing an interior volume for holding a fluid, wherein the vessel includes a fluid discharge port for discharging fluid from the vessel, and a pressure regulating element in the interior volume of the fluid storage and dispensing vessel, arranged to flow fluid therethrough to the fluid discharge port at a set pressure for dispensing thereof; and transmitting a control input from an exterior locus into the vessel to cause the pressure regulating element to change the set pressure of the fluid flowed from the pressure regulating element to the fluid discharge port.

28. A method according to claim 27, wherein the control input comprises an input selected from the group consisting of thermal energy inputs, heated fluid inputs, electromagnetic energy inputs, laser inputs, radio frequency signals, sonic inputs, and fluidic inputs.

29. A method according to claim 27, wherein the control input comprises a fluidic input.

30. A method according to claim 29, wherein the fluidic input comprises a fluid supplied externally of the fluid storage and dispensing vessel.

31. A method according to claim 29, wherein the fluidic input comprises fluid contained in the interior volume of the vessel.

32. A method according to claim 27, wherein the control input comprises one or more thermal input(s) selected from the group consisting of inductive heating, conductive heating, ultrasonic heating, infrared heating, exothermic chemical reaction heating, and neutron capture heating.

33. A method according to claim 27, wherein the control input comprises convective heating.

34. A method of monitoring fluid pressure in an enclosed vessel for holding a fluid, said method comprising sensing pressure of the fluid and transmitting within the vessel a signal correlative thereof to a piezoemitter within the vessel so that the piezoemitter transmits out of the vessel a sonic signal correlative of pressure sensed by the pressure sensor.

35. A method according to claim 34, further comprising detecting the sonic signal outside of the vessel, and generating an output indicative of the pressure of fluid in the vessel.

36. A method of supplying fluid from a storage and dispensing vessel enclosing an interior volume for holding a fluid, and including a fluid discharge port for discharging fluid from the vessel, said method comprising:

disposing an adjustable set point pressure regulator in the interior volume of the fluid storage and dispensing vessel, arranged to flow fluid therethrough to the fluid discharge port at a set point pressure for dispensing thereof;

disposing a remotely actuatable fluid flow control assembly in the interior volume of the fluid storage and dispensing vessel, wherein the fluid flow control assembly is coupled in latent flow communication with the adjustable set point regulator; and remotely actuating the fluid flow control assembly to flow fluid from the interior volume of the vessel to the adjustable set point pressure regulator to change the set point pressure of the regulator.

* * * * *

UNITED STATES PATENT AND TRADEMARK OFFICE

CERTIFICATE OF CORRECTION

PATENT NO. : 6,360,546 B1
DATED : March 26, 2002
INVENTOR(S) : Luping Wang et al.

It is certified that error appears in the above-identified patent and that said Letters Patent is hereby corrected as shown below:

Column 7,
Line 31, cancel "(iSA)" and substitute -- (PSA) --.

Column 12,
Line 67, cancel "fluids" and substitute -- fluidic --.

Signed and Sealed this

Fourth Day of November, 2003

JAMES E. ROGAN
*Director of the United States Patent and Trademark Office*